United States Patent [19]

Scogin

[11] 4,016,858

[45] Apr. 12, 1977

[54] FLOOR FURNACE HEATING SYSTEM

[76] Inventor: Clifford A. Scogin, 427 Vassar, Sugar Creek, Mo. 64053

[22] Filed: July 10, 1975

[21] Appl. No.: 594,596

[52] U.S. Cl. ..... 126/116 B; 98/104; 126/99 C

[51] Int. Cl.[2] ..... F24B 7/00

[58] Field of Search ..... 237/53, 69; 126/116 B, 126/99 R, 110 R, 110 AA, 110 B; 98/101, 104

[56] References Cited

UNITED STATES PATENTS

| | | | |
|---|---|---|---|
| 1,306,420 | 6/1919 | Felton | 98/104 |
| 1,415,234 | 5/1922 | Gramble | 126/116 B |
| 1,708,550 | 4/1929 | Miller | 98/104 |
| 2,056,465 | 10/1936 | Juhnke | 126/116 B |
| 2,072,833 | 3/1937 | Baird et al. | 126/116 B |
| 2,376,172 | 5/1945 | Mueller | 126/116 B |
| 2,482,552 | 9/1949 | Korsgren | 126/116 B |
| 2,517,446 | 8/1950 | Ryder et al. | 126/110 R |
| 3,111,940 | 11/1963 | Wilhoite et al. | 126/116 B |
| 3,880,140 | 4/1975 | Scogin | 126/110 R |

*Primary Examiner*—John J. Camby
*Assistant Examiner*—Henry C. Yuen
*Attorney, Agent, or Firm*—John A. Hamilton

[57] ABSTRACT

A floor furnace heating system including a specially constructed floor furnace adapted to discharge heated air at floor level with a strong radially outward motion component so as to spread horizontally over most of the room area before rising due to its lowered density, the cold air returns to the furnace also being disposed to assist in this spreading of the heated air at lower levels of the room.

3 Claims, 4 Drawing Figures

FLOOR FURNACE HEATING SYSTEM

Figure 1:
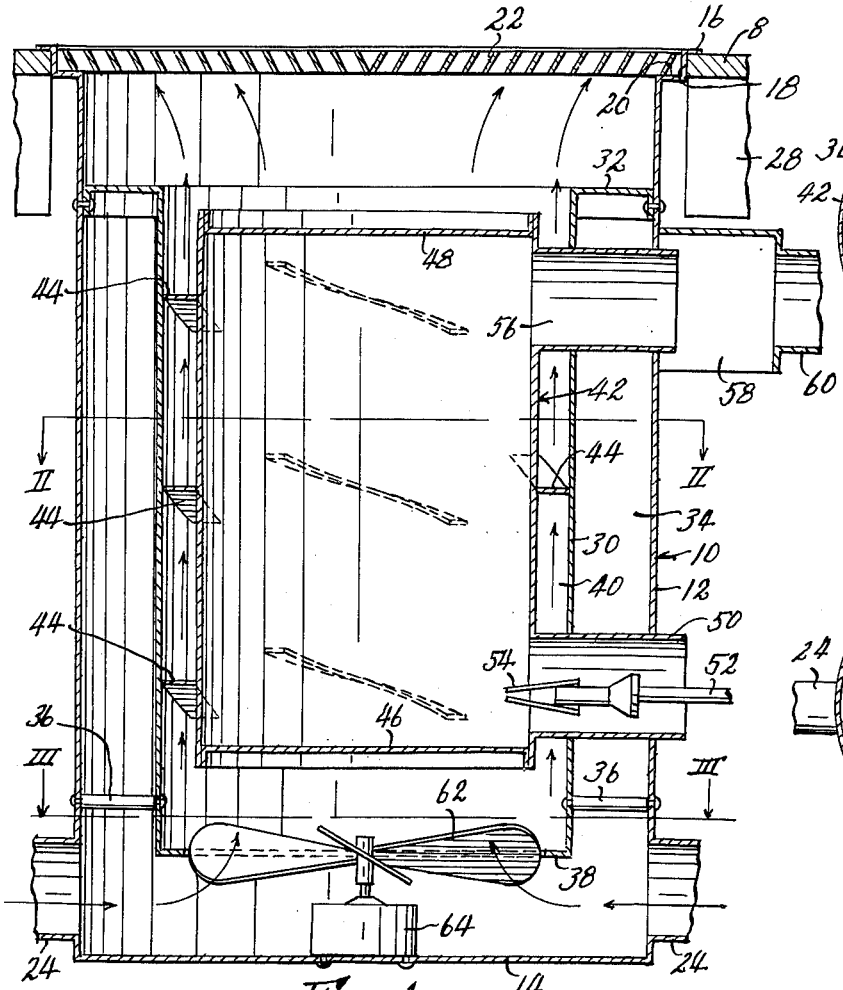

This invention relates to new and useful improvements in heating apparatus, and has particular reference to that class of heaters commonly known as floor furnaces in which the furnace itself is disposed beneath the floor of the space to be heated, and discharges heated air upwardly through said floor to said space.

In previous floor furnaces of this general type, the heated air rises directly to the ceiling, due to its reduced density, spreads horizontally to other parts of the room, falls gradually as it cools and its density correspondingly increases, and eventually returns to the furnace for reheating through return ducts at floor level. This is a normal convection pattern of air flow. However, it naturally results in the fact that the highest air temperatures in the space exist in the ceiling zone, which is largely non-utilized space, with gradually reducing temperatures in zones progressively closer to floor level. The ultimate goal in the system is a comfortable temperature at the "breathing level" of the room, usually considered to be four or five feet from the floor. It will therefore be apparent that the normal convection flow pattern described above normally causes (if the breathing level temperature is proper) an excessively high temperature in the ceiling zone, which reflects uneconomical wastage of fuel energy since the high ceiling temperature serves no useful purpose, and in a correspondingly low temperature in the floor zone of the space, causing room occupants to suffer "cold feet". It will be appparent that if this normal convection air flow pattern could be inverted, so that warm air introduced substantially at floor level could be spread horizontally over the entire room area and then would rise gradually even though being cooled by mixture thereof with the room air, then the room temperatures at floor and breathing elevations could be maintained at a comfort level without heating the ceiling zones to an excessively high temperature, and a definite reduction of fuel consumption would be accomplished. The provision of a floor furnace operable to accomplish this inversion of normal convection air flow patterns in the heated space is the primary object of the present invention.

Generally, this object is accomplished by the provision of a floor furnace operable to deliver air upwardly through a floor register, but with a strong horizontal whirling motion, and with sufficient velocity, that centrifugal force tends to spread the heated air horizontally over the room, substantially at floor level, before it begins to rise due to its reduced density. Furthermore, the air will continue to rise over most of the room area, substantially to the room ceiling, despite the fact that it gradually intermixes with the room air and is therefore cooling to a higher density, due to the volume of hot air continually being delivered thereunder by the furnace. Thus there is produced a rising current of cooling air over the major portion of the room area, which is an inversion of normal convection patterns, and which provides the desired fuel conservation in that only the "living" zones of the room need be heated to comfort level, leaving the non-utilized ceiling zone at a lower temperature. The cooling air eventually sinks from ceiling to floor level closely adjacent the room walls, which is also a largely non-utilized zone, at least insofar as human occupancy is concerned, and returns to the furnace for reheating through floor registers. This air current down the walls to the return registers creates a draft suction from the furnace to the return registers, which also assists in spreading the hot air from the furnace over a greater horizontal area of the room.

Other objects are simplicity and economy of construction, and efficiency and dependability of operation.

Figure 2:
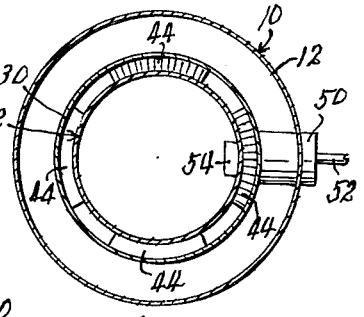
Figure 3:
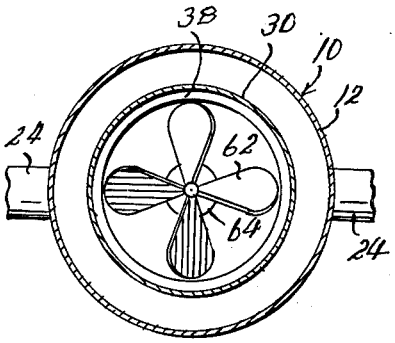
Figure 4:
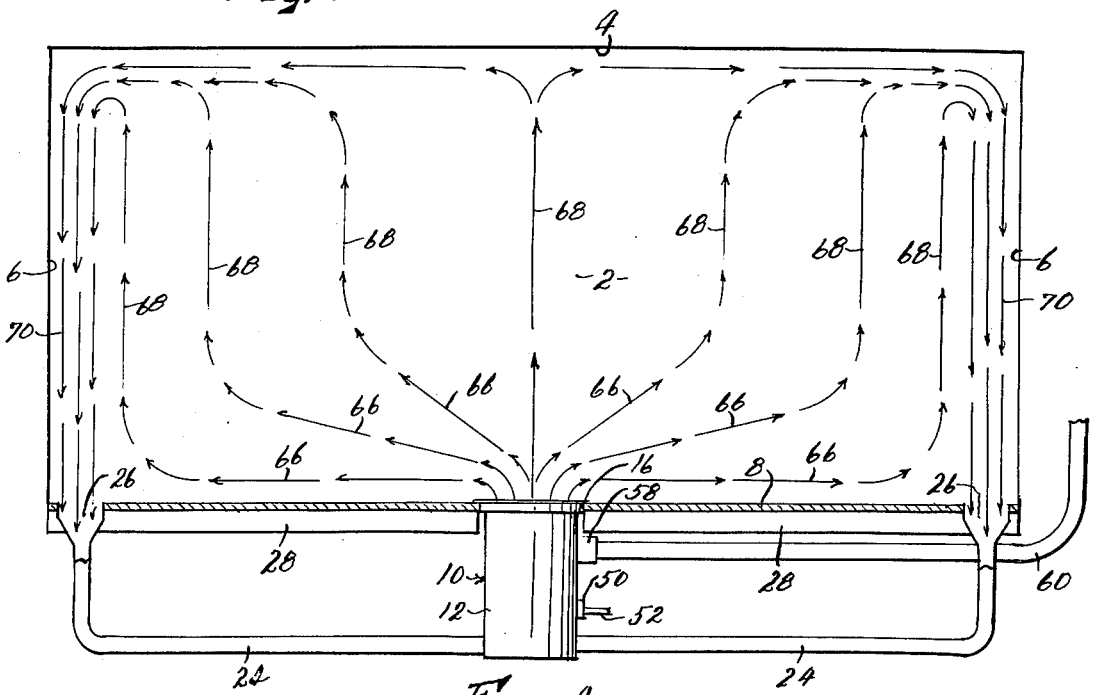

With these objects in view, as well as other objects which will appear in the course of the specification, reference will be had to the accompanying drawing, wherein:

FIG. 1 is a vertical sectional view of a floor furnace embodying the present invention, shown operatively mounted beneath the floor of a room or other space to be heated thereby, FIG. 2 is a reduced sectional view taken on line II—II of FIG. 1, FIG. 3 is a reduced sectional view taken on line III—III of FIG. 1 and FIG. 4 is a diagrammatic view showing the relationship of the furnace to a room or other space to be heated, and indicating the general flow of air within said space.

Like reference numerals apply to similar parts throughout the several views, and in FIG. 4, the numeral 2 applies to a room or other space to be heated, said room having a ceiling 4, walls 6, and a floor 8 beneath which is sufficient space for the mounting of the floor furnace indicated generally by the numeral 10, which is the central feature of the present invention.

Furnace 10 includes a vertically disposed outer housing 12, which is open at its upper end and closed at its lower end by floor 14, and which may be of any desired cross-sectional contour. It is provided at its upper end with an external flange 16 for supporting the furnace in an aperture 18 provided therefore in floor 8, and a circumferential ledge 20 for removably supporting an open-work floor grill 22. Preferably, the louvers of said grill are inclined outwardly and upwardly in all directions from its center, as indicated, in order to assist in the horizontally outward spreading of hot air passing upwardly therethrough, as will appear. The furnace 10 is preferably located as centrally as may be practical of the space to be heated, and any desired number of cold air return conduits 24 interconnect the lower portion of outer housing 12 with return registers 26 opening through floor 8. Conduits 24 are of course disposed below floor 8, and spaces between floor joists 28 may be sealed and used for this purpose, if desired. Registers 26 are preferably disposed as remotely as possible from furnace 10, for reasons which will presently appear.

Disposed within outer housing 12, coaxially therewith, is a cylindrical housing 30 which terminates at its upper end below grill 22, and is provided at its upper end with an external flange 32 which is affixed to outer housing 12 to support housing 30 and to seal the upper end of the air space 34 between said housings. The upper end of housing 30 is otherwise open, and housing 30 is further centered and supported in the outer housing by spacer rods 36 extending therebetween adjacent their lower ends. At its lower end, housing 30 is provided with an internal flange 38 spaced well above floor 14 of the outer housing.

Disposed within housing 30, coaxially therewith but of smaller diameter to provide an annular air passage 40 therebetween, is a cylindrical combustion chamber 42, supported within housing 30 by a plurality of helically curved vanes 44 extending between and welded thereto within air passage 40, whereby to impart a horizontally whirling motion to air moving upwardly through said passage. Said combustion chamber is closed at its lower end by an end wall 46 spaced above bottom flange 38 of housing 30, and at its upper end by an end wall 48 disposed just below flange 32 of housing 30. At its lower end, the combustion chamber is provided with a lateral conduit 50 extending outwardly through housings 30 and 12. Fuel, usually gas, gasoline or oil, is introduced by a fuel pipe 52 through conduit 50 to a burner 54 to burn fuel within the combustion chamber. Secondary combustion air also enters through conduit 50. At its upper end, the combustion chamber is provided with a lateral flue conduit 56 for the escape of the gaseous products of combustion, conduit 56 extending through the walls of housings 30 and 12 and into a downdraft preventer 58 of ordinary design mounted on housing 12 externally thereof, and in turn connected to a flue pipe 60 for disposal of said gases to the outdoor atmosphere.

A blower fan 62 having a vertical axis of rotation is mounted coaxially within the circular opening of flange 38 of housing 30, and has only a minimum operating clearance within said flange, being mounted on the drive shaft of an electric motor 64 mounted centrally of floor 14 of housing 12. It will be understood that the motor 64 and burner 54 may be controlled, as to frequency, duration and sequence of operation by suitable thermostatic controls, such controls being common in the art and hence not shown, since per se they form no part of the present invention.

In operation, it will be seen that so long as fan 62 is in operation, it draws air from room space 2 downwardly through registers 26 and conduits 24 into outer housing 12, where it circulates in air space 34 between housings 12 and 30 and is preheated to some degree therein, then delivered upwardly through the flanged lower end of housing 30 to pass upwardly through the air passage 40 around the combustion chamber, wherein its heating is completed, and thence upwardly through grill 22 back to room space 2. The horizontal whirling motion imparted to the air by vanes 44 in air passage 40 causes the air to leave grill 22 with a motion having a strong radially and horizontally outward component, so that centrifugal force causes the ejected air to move generally horizontally over floor 8, rather than directly upwardly to the ceiling zone as with previous floor furnaces. That is, some of the air will rise in the room over almost its entire area, but the air velocity should be sufficiently great that at least some of the heated air will be moved almost all of the horizontal distance to room walls 6 before it rises appreciably. This initial flow path of the air is indicated by arrows 66 in FIG. 4. Once the air begins to rise, as further indicated by arrows 68, it of course is being intermixed with room air, and is hence being cooled and its density increased. Nevertheless, in the present system, it continues to rise despite its increasing density, due to the continuous delivery of a relatively high volume of hot air therebeneath by the furnace, over substantially the entire room area. Thus the floor and breathing levels of the room are maintained warmer than the ceiling zone, with the fuel conservation resulting from this pattern as previously discussed. Eventually this rising current of cooling air over most of the room area, which is an inversion of the usual convection pattern, reaches the ceiling and moves to the wall zones, where it falls, due to its increased density, and is returned to the furnace, as indicated by arrows 70. The radially outward draft from the furnace confines the downflow of cooler air to registers 26 largely to a shallow vertical zone directly adjacent the walls, an area in which a cool draft is not usually considered objectionable since it is not usually occupied by humans.

Additionally, the downdraft at the walls creates a draft outwardly from the furnace just above floor level, and this further assists in spreading the hot air delivered by the furnace over a still greater area of the room. Of course, the return registers could, alternatively, be placed in walls 6 adjacent the ceiling, with the return conduits to the furnace then incorporating vertical conduits within the wall structures. This would provide "warm" walls by eliminating the downdraft of cool air adjacent the walls, but would not provide the draft assistance, described above, in spreading the warm air from the furnace over a larger area of the room.

The "inversion" of the normal convection air flow currents in the room, as described above, requires the ejection of air from grill 22 at a considerably higher velocity than would otherwise be necessary, in order to provide the centrifugal force and momentum necessary to spread the hot air over at least a major portion of the room area at or adjacent floor level. This added velocity is provided by fan 62, and by the fact that air delivered upwardly by said fan, through the full area of the opening of flange 38, must then pass through the relatively restricted annular area of passage 40, which naturally increases its velocity. This produces a back pressure just above the fan, but rearward leakage of air around the fan is prevented by the close fit of said fan within the flange. Therefore the increased air velocity in passage 40 is maintained. At the same time, the increased air velocity around the combustion chamber should be accomplished without substantially increasing the total volume of air flow, since the desired air volume is largely a function of the rate of fuel consumption for which burner 54 is set, and an increase of air volume would necessitate the burning of additional fuel to provide the desired output temperature. Also, the time of retention of the air adjacent the combustion chamber should not be reduced by the increased velocity of air in this zone, since this would result in inefficient and inadequate heating of the air. In the present furnace, the reduction of flow area between the opening of flange 38 and annular air passage 40 provides the required flow velocity without increase in the total cubic footage of air delivered, and the vanes 44 in passage 40 provide that the air must travel a long generally helical path within said passage, thereby providing the necessary retention time for the air despite its increased velocity.

While I have shown and described a specific embodiment of my invention, it will be readily apparent that many minor changes of structure and operation could be made without departing from the spirit of the invention.

What I claim as new and desire to protect by Letters Patent is:

1. A floor furnace comprising:

a. a housing open at top and bottom, b. means operable to suspend said housing beneath the floor of a room space to be heated, in sealed communication with an aperture formed in said floor, c. a power driven fan disposed operatively in the bottom opening of said housing and operable to delivery air upwardly through said housing, d. a combustion chamber supported within said housing to form an annular air passage therebetween through which air delivered by said fan must travel, e. means for burning fuel within said combustion chamber, f. air directing means disposed within said air passage and operable to impart a horizontal whirling motion to air moving upwardly through said air passage as it is heated by said combustion chamber, whereby air emerging upwardly from said air passage and floor aperture into said room space is caused by centrifugal force to flow generally horizontally outwardly from said aperture over a major portion of the area of said room space, at or adjacent the floor thereof, g. an outer housing of greater horizontal cross-sectional area than said first-named housing suspended from said floor aperture, and in which said first-named housing and said combustion chamber are in turn suspended, said outer housing extending below said first-named housing and being closed at its lower end, h. means sealing the upper end of the air space between said outer and first-named housings, and i. means for admitting air to said last-named air space.

2. A floor furnace as recited in claim 1 wherein said means for admitting air to said outer housing comprises air return ducts each with its opposite ends connected respectively to said outer housing and to said room space.

3. A floor furnace as recited in claim 2 wherein said furnace is disposed generally centrally of the room space to be heated thereby, and wherein said return ducts open through the floor of said room space generally as remotely as possible from said furnace, adjacent the walls of said room space.

* * * * *